US007770650B2

(12) United States Patent
Young et al.

(10) Patent No.: US 7,770,650 B2
(45) Date of Patent: Aug. 10, 2010

(54) INTEGRAL ORIENTATION SYSTEM FOR HORIZONTAL TREE TUBING HANGER

(75) Inventors: Stuart F. Young, Banchory (GB); Martyn J. Lord, Ellon (GB)

(73) Assignee: Vetco Gray Inc., Houston, TX (US)

( * ) Notice: Subject to any disclaimer, the term of this patent is extended or adjusted under 35 U.S.C. 154(b) by 967 days.

(21) Appl. No.: 11/541,765

(22) Filed: Oct. 2, 2006

(65) Prior Publication Data

US 2008/0078555 A1 Apr. 3, 2008

(51) Int. Cl.
*E21B 41/04* (2006.01)

(52) U.S. Cl. ..... 166/344; 166/338; 166/339; 166/341; 166/368; 166/381

(58) Field of Classification Search ..... 166/344, 166/338, 339, 341, 347, 349, 368, 381, 77.51, 166/85.5
See application file for complete search history.

(56) References Cited

U.S. PATENT DOCUMENTS 4,691,780 A * 9/1987 Galle et al. ..... 166/348
4,721,163 A * 1/1988 Davis ..... 166/341
5,145,006 A * 9/1992 June ..... 166/341
5,372,199 A * 12/1994 Cegielski et al. ..... 166/368
5,975,210 A * 11/1999 Wilkins et al. ..... 166/341
6,050,339 A * 4/2000 Milberger ..... 166/368
6,360,822 B1 * 3/2002 Robertson ..... 166/368
6,516,876 B1 * 2/2003 Jennings ..... 166/77.51
6,655,455 B2 * 12/2003 Bartlett et al. ..... 166/86.2
6,675,900 B2 * 1/2004 Baskett et al. ..... 166/379
6,805,200 B2 * 10/2004 DeBerry ..... 166/347
7,028,664 B2 * 4/2006 Wolf ..... 123/321
7,063,157 B2 * 6/2006 Bartlett ..... 166/339
7,069,988 B2 * 7/2006 Bartlett et al. ..... 166/86.2
7,121,345 B2 * 10/2006 Bartlett ..... 166/345
7,165,620 B2 * 1/2007 Steedman ..... 166/368
2004/0231835 A1 * 11/2004 Thai et al. ..... 166/75.13
2005/0061499 A1 * 3/2005 Hopper ..... 166/84.3
2006/0108118 A1 * 5/2006 Bartlett ..... 166/338

FOREIGN PATENT DOCUMENTS

GB 2349662 A 11/2000

* cited by examiner

*Primary Examiner*—Thomas A Beach
*Assistant Examiner*—Matthew R Buck
(74) *Attorney, Agent, or Firm*—Bracewell & Giuliani

(57) ABSTRACT

A horizontal tree has a lateral passage extending from its bore. A tubing hanger having a lateral passage lands in the bore of the tree. The tubing hanger has an orientation guide mounted to it. A retractable pin is mounted in the sidewall of the tree. The orientation guide on the tubing hanger engages the pin to rotate the tubing hanger as it is being landed.

17 Claims, 3 Drawing Sheets

INTEGRAL ORIENTATION SYSTEM FOR HORIZONTAL TREE TUBING HANGER

FIELD OF THE INVENTION

This invention relates in general to subsea wellhead systems, and in particular to a tubing hanger having an orientation sleeve and a retractable guide pin mounted in a horizontal tree for orienting the tubing hanger as it is lowered into a horizontal tree.

BACKGROUND OF THE INVENTION

One type of offshore oil and gas well utilizes a subsea Christmas or production tree. The tree lands on top of a high pressure wellhead housing, which is in turn supported by a low pressure wellhead housing. The high pressure wellhead housing contains one or more strings of casing.

In one type of subsea tree, known as a horizontal tree or a spool tree, the tree is landed on the high pressure wellhead housing before the tubing hanger and tubing are run. After the tree is landed, the tubing is lowered through the tree and the tubing hanger lands in the tree. The tree has a lateral production outlet, and the tubing hanger has a lateral production passage that must align with the production outlet when it lands. In a producing well, well fluid flows up the tubing and out the production outlet of the tree.

The tree and the tubing hanger may have additional ports that must register with each other, such as ports for hydraulic fluid for a downhole safety valve. One type of orientation system for orienting the tubing hanger comprises a sleeve secured to the lower end of the tree while the tree is being run. The sleeve stabs sealingly into the uppermost casing hanger in the high pressure wellhead housing. The sleeve has an internal helical profile or "muleshoe" formed in it. The tubing hanger has an orientation pin that engages the helical edge to rotate the tubing hanger as it is landed in the tree.

While these systems work well, the orientation sleeve guide edge as described presents an obstacle for components attached to the tubing, such as an electrical submersible pump. The pump is normally larger in diameter than the tubing and typically has a power cable extending upward alongside the tubing. The power cable might catch and be damaged on the orientation sleeve guide edge.

Additionally, an orientation system as described requires installing all of the casing hangers before running the tree. In some cases, the operator desires to land the tree on the high pressure wellhead housing before the last casing string has been run. The tree would not have an orientation sleeve on its lower end that stabs into a casing hanger because the last casing hanger would not yet have been run. In a drill-through system, after landing the tree, the operator lowers the drill pipe through the tree to drill the well to final depth, and then installs the final casing hanger and casing through the tree. Subsequently, the operator will run the tubing hanger, and other provisions have to be made to orient the tubing hanger because the tree would not have an orientation sleeve as described.

A drill-through horizontal tree may have an orientation sleeve secured to it before running the tree, but if so, the result may be a smaller inner diameter of the through-bore than desired. The sleeve would need to be protected from damage due to the drill string passing through the sleeve during drilling. An orientation sleeve can be installed in the tree or wellhead housing after the drilling has been completed and the casing hanger run, but this procedure necessitates an additional trip from the surface to the subsea wellhead assembly. The additional trip is costly because of the large expense of operating an offshore drilling rig.

Retractable guide pins have been used for orienting tubing hangers in subsea wellhead systems other than horizontal trees. FIG. 6 of U.S. Pat. No. 7,063,157 discloses a helix 104 on a tubing hanger running tool 96 that engages a retractable pin 88 in tubing hanger orientation body 74. Tubing hanger 48 (FIG. 2) lands in wellhead housing 20, not in a horizontal tree. U.S. Pat. No. 4,721,163 shows a retractable pin 21 in a orientation spool 26 that engages a guide slot 66 on a tubing hanger running tool 59.

SUMMARY OF THE INVENTION

In this invention, the subsea wellhead assembly utilizes a horizontal production tree having a bore through it and a laterally extending production outlet. A tubing hanger lands in the bore for supporting a string of tubing extending into the well. The tubing hanger has a laterally extending production passage. The tubing hanger has an orientation guide carried by it, the guide being a sleeve enclosing an upper portion of the connection of the tubing hanger with the tubing.

A retractable pin is mounted in the sidewall of the tree. The pin moves from a retracted position outside of the bore of the tree to an extended position protruding into the bore of the tree before the tubing hanger enters the bore of the tree. In the extended position, the pin will be engaged by the orientation guide of the tubing hanger as the tubing hanger is landing. The orientation guide rotates the tubing hanger to the desired orientation.

DETAILED DESCRIPTION OF THE INVENTION

Figure 4:
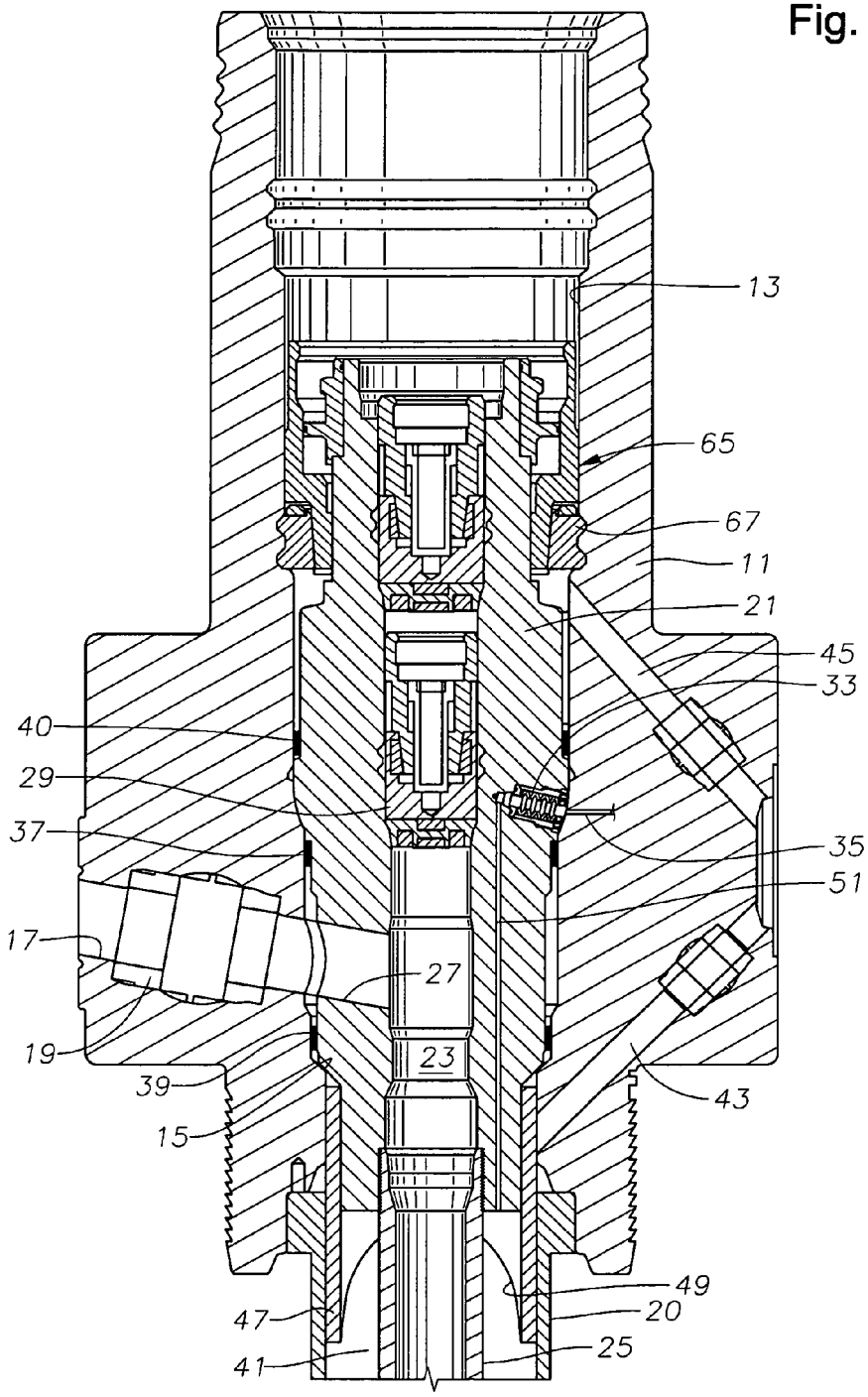
FIG. 4 is a vertical sectional view of the tree and tubing hanger of FIG. 1, but taken along a section plane 90 degrees from that of FIG. 1 and showing the tubing hanger in an installed position.

Referring to FIG. 4 initially, Christmas or production tree 11 is of a type known as a horizontal or spool tree. Production tree 11 has a sidewall that defines a bore 13 having a landing shoulder 15 therein. A production outlet 17 extends from bore 13 to the exterior at a point above landing shoulder 15. A production valve 19 is mounted to production outlet 17.

Figure 1:
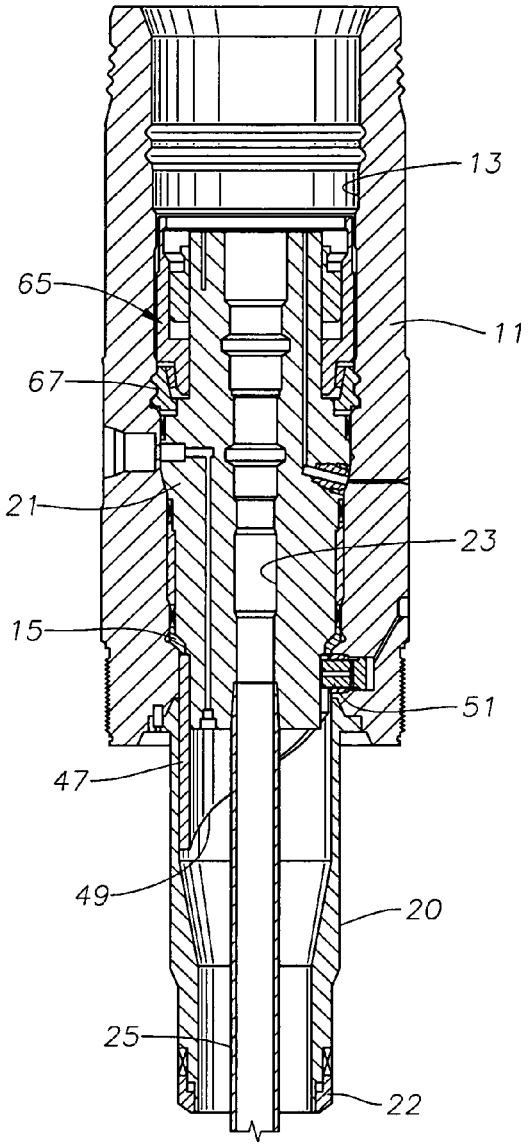
FIG. 1 is a vertical sectional view of a horizontal tree with a tubing hanger installed, the tubing hanger and tree having an orientation system constructed in accordance with this invention.

Referring also to FIG. 1, in this example, tree 11 has a tubular isolation sub 20 secured to its lower end prior to running tree 11. Although not shown, tree 11 will have a wellhead connector mounted to the threads on its lower diameter for connecting to a high pressure wellhead housing (not shown). The wellhead housing has one or more casing hangers installed therein. Isolation sub 20 has seals 22 on its lower end that stab into the uppermost casing hanger in the wellhead housing. If the operator prefers to drill through tree 11 and lower casing through tree 11, then isolation sub 20 as shown would not be utilized.

Referring again to FIG. 4, a tubing hanger 21 is shown in a landed position within tree 11. Tubing hanger 21 has an axial passage 23 extending through it that has an axis coaxial or parallel with the axis of bore 13. Passage 23 registers with the interior of a string of tubing 25 secured to the lower end of tubing hanger 21. Tubing 25 is lowered into the well within the production casing for the flow of well fluid. A lateral passage 27 extends from tubing hanger axial passage 23. Lateral passage 27 orients and aligns with tree production outlet 17.

Prior to production operations, one or more retrievable plugs 29 will be installed within tubing hanger axial passage 23 above lateral passage 27. In this example, tubing hanger 21 has a plurality of hydraulic fluid passages 31 (only one shown) spaced circumferentially apart from each other around axial passage 23. Passages 31 lead to hydraulic lines that extend down alongside tubing 25 to downhole safety valves and possibly other equipment in the well. Passage 31 has a seal member and check valve 33 on an exterior portion of tubing hanger 21 above lateral passage 27. Production tree 11 has a plurality of hydraulic passages 35 (only one shown) that register with each seal element 33 for transmitting hydraulic fluid pressure to one of the downhole safety valve passages 31.

An upper annular seal 37 extends around tubing hanger 21 above lateral passage 27 and production outlet 17. A lower annular seal 39 extends around tubing hanger 21 below lateral passage 27 and production outlet 17. Seals 37, 39 seal the exterior of tubing hanger 21 to tree bore 13. A test seal 40 encircles tubing hanger 21 for sealing to bore 13 above the individual seal elements 33 to enable testing of seal elements 33.

A tubing annulus 41 surrounds production tubing 25 within the casing in the well. Tubing annulus 41 is sealed at its upper end by lower annular seal 39. A tubing annulus passage 43 extends through the sidewall of tree 11 from bore 13 to the exterior. The lower end of tubing annulus passage 43 is located below lower annular seal 39. Passage 43 leads to a valve (not shown) on the exterior of tree 11. An upper tubing annulus passage 45 leads from the exterior valve back into bore 13 above annular test seal 40. Passages 43 and 45 enable circulation of fluid from the interior of tubing 25 to the tubing annulus 41 during installation and workover operations.

Referring again to FIG. 1, an orientation guide 47 is secured to the lower end of tubing hanger 21. In this embodiment, orientation guide 47 comprises a sleeve fastened to a cylindrical lower portion of tubing hanger 21 by fasteners (not shown). The outer diameter of the upper portion of sleeve 47 is slightly less than the inner diameter of tree bore 13 and the inner diameter of the upper portion of isolation sub 20. Orientation guide 47 has a lower helical edge 49 that extends from the lower end helically upward, then downward in a general configuration known as a mule "muleshoe".

Figure 3:
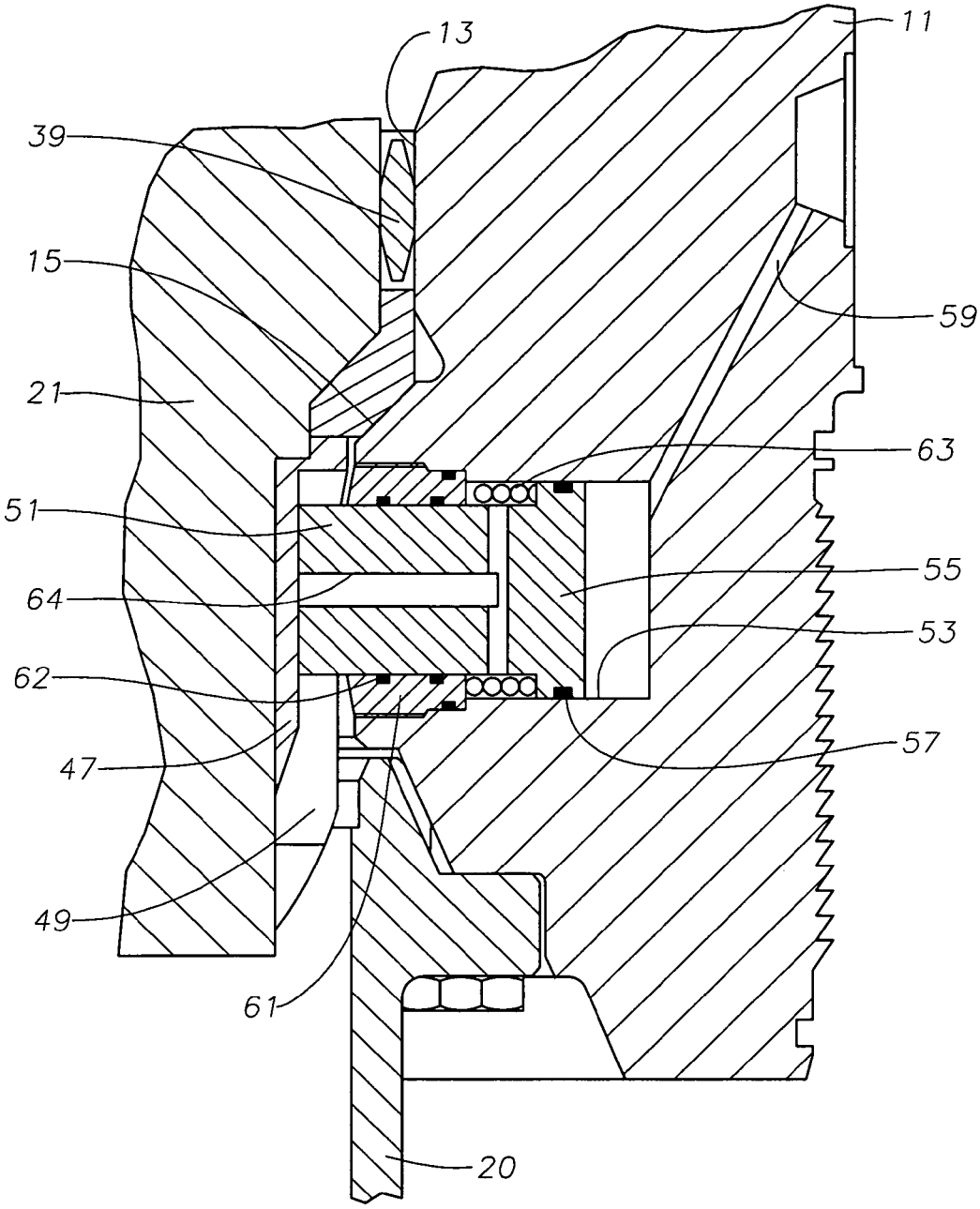
FIG. 3 is an enlarged partial sectional view of a portion of the tree of FIG. 1, showing the orientation pin in an extended position.

A retractable guide pin 51 is mounted to tree 11 for engaging helical edge 49. In this embodiment, guide pin 51 is mounted at the lower end of tree 11 below landing shoulder 15. Optionally, guide pin 51 could be mounted in the upper portion of tree 11. As shown in FIG. 3, guide pin 51 is located in a cylindrical cavity 53 extending into the sidewall of tree 11 from bore 13. Preferably, cavity 53 has an axis that is perpendicular to the axis of bore 13. Guide pin 51 has a piston portion 55 with a seal 57 that sealingly engages cavity 53. A hydraulic passage 59 extends from an outer portion of cavity 53 to the exterior of tree 11 for receiving hydraulic fluid pressure. Guide pin 51 is retained in cavity 53 by a retainer ring 61, which is secured by threads. Retainer ring 61 has seals 62 in its interior that sealingly engage a portion of guide pin 51 and a seal on its exterior that seals to the bore of cavity 53. Piston portion 55 at seal 57 has a larger outer diameter than guide pin 51 at seal 62 in this example.

Coil spring 63 is compressed between an inward facing flange on piston portion 55 and retainer ring 61. Coil spring 63 urges piston portion 55 and guide pin 51 to an outer or retracted position. Hydraulic fluid pressure applied through passage 59 overcomes the force of coil spring 63 and pushes guide pin 51 to the extended position shown in FIG. 3. In the extended position, guide pin 51 engages helical edge 49 of orientation guide 47. To prevent hydraulic lock when piston portion 55 moves toward retainer ring 61, a fluid relief passage 64 extends from the inner end of guide pin 51 to the outer diameter of guide pin 51 at coil spring 63 between seals 62 and 57. When piston portion 55 moves toward retainer ring 61, passage 64 allows displaced fluid to flow from the chamber surrounding coil spring 63 into tree bore 13. Passage 64 and the chamber between seals 57, 62 surrounding coil spring 63 are packed with a suitable grease in order to minimize the potential for ingress of well fluid into the chamber containing coil spring 63.

Figure 2:
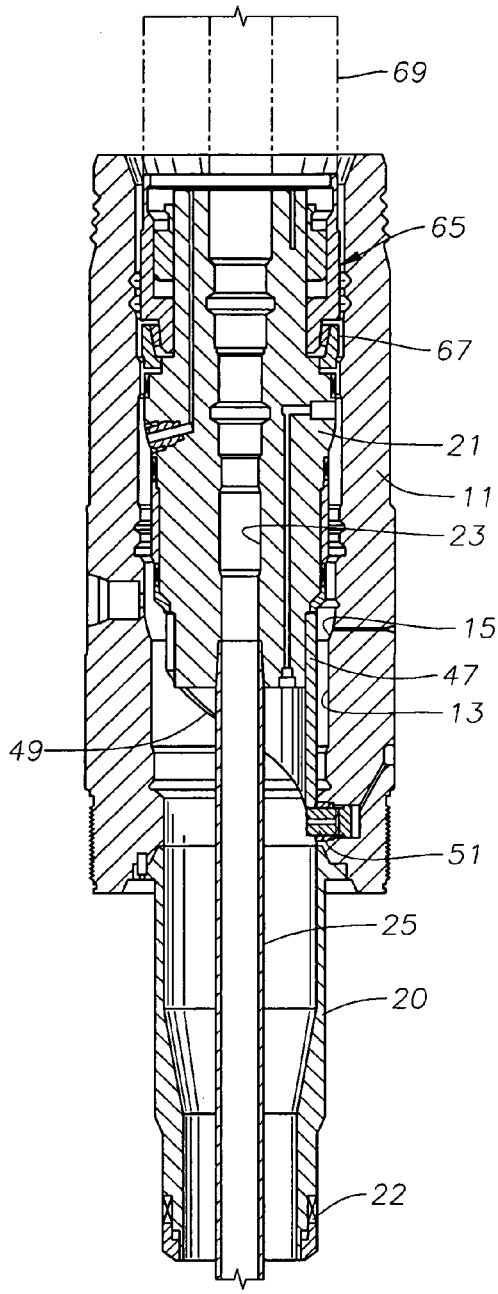
FIG. 2 is a sectional view of the tree and tubing hanger of FIG. 1, showing the tubing hanger as it enters the tree but prior to landing.

Referring to FIG. 2, a lock assembly 65 is located on the upper end of tubing hanger 21. Lock assembly 65 has a lock element 67 that is moved by running tool 69 to a locked position, shown in FIGS. 1 and 4, after tubing hanger 21 has been installed. Running tool 69 is a conventional member that secures conventionally to tubing hanger 21 while it is being run, and then it is retrieved.

In one method of operation, the well is drilled and cased before the running of tree 11. Then, tree 11 is run, and isolation sub 20 will stab sealingly into the uppermost casing hanger as the connector (not shown) on tree 11 connects tree 11 to the high pressure wellhead housing. After tree 11 has been landed, a blowout preventer and riser (not shown) will be connected from the upper end of tree 11 to the surface. Orientation guide pin 51 will be retracted with its inner end flush or recessed within cavity 53 (FIG. 3), providing a smooth bore through tree 11 and isolation sub 20. The operator optionally may perform some drilling operations through tree 11 and isolation sub 20, such as drilling out a cement plug. Tree 11 will normally have a wear bushing (not shown) while it is being run, and the wear bushing may extend below orientation guide pin 51 while orientation guide pin 51 is retracted. The wear bushing is retrieved just before the running of tubing 25.

The operator then makes up a string of tubing 25 and lowers it through the riser, blowout preventer and into the casing in the well. Components larger than the outer diameter of tubing 25 may be connected into the string of tubing 25. These components might include an electrical submersible pump. The operator runs tubing 25 by securing tubing hanger 21 to the upper end of tubing 25, securing running tool 69 to tubing hanger 21 and securing running tool 69 to a string of conduit, typically drill pipe. Guide pin 51 is preferably in a retracted position while large diameter components, such as an electrical submersible pump, are lowered through tree 11. Even without an electrical submersible pump, the operator may choose to leave guide pin 51 retracted while at least part of tubing 25 passes through tree 11. When tubing hanger 21 nears tree 11, the operator will supply hydraulic fluid pressure to hydraulic passage 59, causing guide pin 51 to move to the extended position protruding into bore 13.

As shown in FIG. 2, the helical edge 49 of orientation guide 47 will contact guide pin 51 as tubing hanger 21 nears landing shoulder 15. The engagement of guide pin 51 with helical edge 49 causes tubing hanger 21 to rotate and orient to the aligned position shown in FIGS. 1 and 4. In the aligned position, tubing hanger lateral passage 27 aligns with tree production outlet 17. Also, the various auxiliary seals 33 simultaneously align with their ports 35.

After landing tubing hanger 21 on shoulder 15, the operator actuates running tool 69 (FIG. 2) to cause locking element 67 to move to an engaged position engaging a profile in bore 13. The operator can circulate a fluid through tubing annulus 41 and tubing 25 in a conventional manner utilizing tubing annulus passages 43 and 45. The operator disconnects running tool 69 and retrieves it to the surface. Guide pin 51 no longer needs to be maintained in the extended position, thus hydraulic fluid pressure at port 59 may be removed, and spring 63 will push piston 55 and guide pin 51 to the retracted position.

In another method of operation, tree 11 will be installed on the high pressure wellhead housing (not shown) before the drilling has been completed. In that instance, isolation sub 20 would not be utilized. The operator would drill through bore 13 and run casing through bore 13 while guide pin 51 is in the retracted position. Guide pin 51 would be extended only when tubing hanger 21 is being run.

The invention has significant advantages. Prior to extending the guide pin, the tree and isolation sub provide a smooth bore, facilitating various operations prior to running the tubing hanger. The smooth bore avoids damage to components being lowered with the tubing, such as an electrical submersible pump. If the tree is used as a drill-through tree, a larger diameter can be utilized since the orientation member does not need to be run with the tree. An additional trip merely to install an orientation sleeve is not required.

While the invention has been shown in only one of its forms, it should be apparent to those skilled in the art that it is not so limited but is susceptible to various changes without departing from the scope of the invention.

The invention claimed is:

1. A subsea wellhead assembly, comprising:

a production tree having a bore therethrough and a production outlet extending laterally from the bore to an exterior of the tree;

a tubing hanger landed in the bore for supporting a string of tubing extending into the well, the tubing hanger having a laterally extending production passage;

an orientation guide carried by the tubing hanger;

a retractable pin mounted in the sidewall of the tree, the pin being movable from an outward retracted position to an inward extended position protruding into the bore of the tree for engaging the orientation guide to orient the production passage of the tubing hanger with the production outlet as the tubing hanger lands in the bore;

a cavity extending into the side wall of the tree from the bore;

a piston on the pin that is carried sealingly in the cavity, the pin extending inward from the piston, the piston defining an inward facing shoulder;

a spring within the cavity, having an inner end secured to the sidewall of the tree and an outer end in engagement with the inward facing shoulder of the piston for urging the piston and the pin to the outward retracted position;

a hydraulic fluid passage leading to the cavity on an outward side of the piston for supplying hydraulic fluid pressure to move the piston and the pin to the extended position; and wherein the spring is positioned to be immersed in fluid in the bore of the tree.

2. The wellhead assembly according to claim 1, wherein the pin is mounted in the tree below the production outlet.

3. The wellhead assembly according to claim 1, wherein the orientation guide is located below the laterally extending production passage of the tubing hanger.

4. The wellhead assembly according to claim 1, wherein the orientation guide comprises a sleeve having a helical edge for engagement by the pin, the sleeve being mounted to the tubing hanger below the laterally extending production passage.

5. The wellhead assembly according to claim 1, wherein:

the pin is mounted in the tree below the production outlet; and the orientation guide is located below the laterally extending production passage of the tubing hanger.

6. The wellhead assembly according to claim 1, further comprising a tubing annulus passage extending from the bore in the tree below the production outlet through a sidewall of the tree and back into the bore in the tree above the production outlet.

7. A subsea wellhead assembly, comprising:

a production tree having a sidewall defining a bore therethrough and a production outlet extending laterally through the sidewall from the bore to an exterior of the tree;

a landing shoulder in the bore of the tree;

a tubing hanger supported on the landing shoulder for supporting a string of tubing extending into the well, the tubing hanger having a laterally extending production passage and annular seals located above and below the production passage that sealingly engage the bore;

an orientation guide having a helical edge surface and mounted to the tubing hanger below the annular seals;

a hydraulically actuated pin mounted in the sidewall of the tree, the pin being movable from an outward retracted position outside of the bore of the tree to an inward extended position protruding into the bore of the tree;

while in the extended position, the pin being engageable by the helical edge surface of tile guide as the tubing hanger is lowered into the well to rotate the tubing hanger to a position wherein the production passage of the tubing hanger is aligned with the production outlet;

a cavity extending into the side wall of the tree from the bore;

a piston portion on the pin that is carried sealingly in the cavity, the pin extending inward from the piston portion, the piston portion defining an inward facing shoulder;

a retainer secured to an inner end of the cavity that provides a limit for inward movement of the pin;

a spring compressed between the retainer and the inward facing shoulder of the piston portion for urging the piston portion and the pin to the outward retracted position;

a hydraulic fluid passage leading to the cavity on an outward side of the piston portion for supplying hydraulic fluid pressure to move the piston portion and the pin to the extended position; and wherein the portion of the cavity containing the spring is in fluid communication with the bore of the tree.

8. The wellhead assembly according to claim 7, wherein the pin is mounted in the sidewall of the tree below the production outlet.

9. The wellhead assembly according to claim 7, further comprising a tubing annulus passage extending through the sidewall of the tree, a lower end of the tubing annulus passage intersecting the bore in the tree below the annular seals of the tubing hanger and an upper end of the tubing annulus passage intersecting the bore in the tree above the annular seals of the tubing hanger.

10. The wellhead assembly according to claim 7, wherein the retainer comprises a retainer ring secured to the cavity and encircling the pin; and the spring comprises a coil spring encircling the pin between the retainer ring and the piston portion.

11. The wellhead assembly according to claim 7, wherein:

the retainer and the piston portion define a coil spring chamber within the cavity, the coil spring being located within the coil spring chamber; and wherein the wellhead assembly further comprises:

a fluid relief passage extending from the coil spring chamber through the pin to an inner end of the pin for communication with the bore of the tree.

12. A method of installing a tubing hanger with a laterally extending production passage in a bore of a production tree having a laterally extending production outlet, comprising:

(a) mounting a retractable pin within the tree, the pin having a piston portion carried sealingly within a cavity in a sidewall of the tree, mounting a spring in the cavity on an inward side of the piston portion and biasing the piston portion and the pin to an outward retracted position with the spring;

(b) securing an orientation guide to the tubing hanger;

(c) applying hydraulic fluid pressure to an outward side of the piston portion and moving the pin inward so that it protrudes into the bore of the tree, the spring being immersed in fluid in the bore of the tree; and (d) lowering the tubing hanger into the bore of the tree and engaging the orientation guide with the pin, causing the tubing hanger to rotate to orient the production passage of the tubing hanger with the production outlet of the tree.

13. The method according to claim 12, wherein:

step (d) comprises connecting the tubing hanger to a running tool and lowering the running tool on a string of conduit; and the method further comprises after step (d)

disconnecting the running tool from the tubing hanger and retrieving the running tool while leaving the orientation guide attached to the tubing hanger.

14. The method according to claim 12, wherein step (b) comprises securing a sleeve having a helical edge to a lower portion of the tubing hanger.

15. The method according to claim 12, wherein step (c) occurs after at least part of the tubing has been lowered through the tree and before the tubing hanger enters the bore of the tree.

16. The method according to claim 12, further comprising prior to steps (c) and (d) lowering drill pipe through the bore of the tree and drilling at least part of the well while the pin is in the retracted position outward from the bore of the tree.

17. The method according to claim 12, further comprising prior to steps (c) and (d):

lowering drill pipe through the bore of the tree and drilling at least part of the well while the pin is in the retracted position outward from the bore of the tree; then while the pin is still retracted, lowering a casing hanger and string of casing through the tree and landing the casing hanger in a wellhead housing below the tree.

* * * * *